US009995540B2

(12) United States Patent
Nakamura

(10) Patent No.: US 9,995,540 B2
(45) Date of Patent: Jun. 12, 2018

(54) TANK STRUCTURE FOR HEADER-PLATE-LESS HEAT EXCHANGER

(71) Applicant: T.RAD Co., Ltd., Shibuya-ku, Tokyo (JP)

(72) Inventor: Yoichi Nakamura, Tokyo (JP)

(73) Assignee: T.RAD CO., LTD., Tokyo (JP)

( * ) Notice: Subject to any disclaimer, the term of this patent is extended or adjusted under 35 U.S.C. 154(b) by 73 days.

(21) Appl. No.: 15/021,334

(22) PCT Filed: Sep. 5, 2014

(86) PCT No.: PCT/JP2014/074157
§ 371 (c)(1),
(2) Date: Mar. 11, 2016

(87) PCT Pub. No.: WO2015/037687
PCT Pub. Date: Mar. 19, 2015

(65) Prior Publication Data

US 2016/0223272 A1 Aug. 4, 2016

(30) Foreign Application Priority Data

Sep. 13, 2013 (JP) ..... 2013-190836

(51) Int. Cl.
*F28F 9/02* (2006.01)
*F28F 3/02* (2006.01)
(Continued)

(52) U.S. Cl.
CPC ..... *F28F 9/0221* (2013.01); *F28D 7/1684* (2013.01); *F28F 1/025* (2013.01);
(Continued)

(58) Field of Classification Search
CPC .... F28F 9/18; F28F 9/0037; F28F 9/02; F28F 9/0219; F28F 9/0221; F28F 9/0224;
(Continued)

(56) References Cited

U.S. PATENT DOCUMENTS 2,428,066 A * 9/1947 Ellis ..... B60H 1/00335 165/154
2,899,177 A * 8/1959 Harris et al. ..... B21D 53/04 165/153
(Continued)

FOREIGN PATENT DOCUMENTS

EP 1574802 A2 9/2005
EP 2469211 A2 * 6/2012 ..... F28D 7/1684
(Continued)

*Primary Examiner* — Jianying Atkisson
*Assistant Examiner* — For K Ling
(74) *Attorney, Agent, or Firm* — Norris McLaughlin & Marcus, P.A.

(57) ABSTRACT

In order to reliably eliminate gaps between a core and a tank arranged at both ends of a header-plate-less heat exchanger, and thus to ensure air-tightness and liquid-tightness of the tank, an upper fitting part and a lower fitting part of the tank protrude from a side plate part, and are deformable in the thickness direction, and those portions respectively make contact with and fit onto the inner surface of the uppermost and the lowermost tube, with the fitting parts being integrally soldered and secured.

14 Claims, 7 Drawing Sheets

(51) Int. Cl.
*F28F 9/00* (2006.01)
*F28F 1/02* (2006.01)
*F28D 7/16* (2006.01)
*F28D 9/00* (2006.01)

(52) U.S. Cl.
CPC ..... *F28F 3/02* (2013.01); *F28F 9/001* (2013.01); *F28D 9/0037* (2013.01)

(58) Field of Classification Search
CPC .... F28F 9/12; F28F 9/182; F28F 3/086; F28F 9/08; F28F 9/001; F28F 9/00; F28D 1/0308; F28D 9/0031; F28D 9/0037; F28D 9/001
USPC ..... 165/166, 167, 172, 173, 157, 158
See application file for complete search history.

(56) References Cited

U.S. PATENT DOCUMENTS 7,159,650 B2 * 1/2007 Brost ..... F28D 9/0043 165/167
7,195,060 B2 * 3/2007 Martin ..... F28D 9/0043 165/157
8,002,022 B2 * 8/2011 Geskes ..... F02B 29/0462 165/157
8,651,170 B2 * 2/2014 Maeda ..... F28D 7/0041 165/152
8,708,036 B2 * 4/2014 Ikeda ..... F02B 29/0462 165/157
2006/0219394 A1 10/2006 Martin et al.
2008/0164014 A1 * 7/2008 Nakamura ..... F28D 9/0025 165/165
2010/0319889 A1 * 12/2010 Ikeda ..... F02B 29/0462 165/157
2011/0247318 A1 10/2011 Kuroyanagi et al.

FOREIGN PATENT DOCUMENTS

JP 2011-002133 1/2011
JP 2011-038752 2/2011
JP 2011038752 A * 2/2011 ..... F28F 9/0221
JP 2011043257 A * 3/2011 ..... F28F 9/0221
JP 2011-232020 11/2011
JP 2012-137251 7/2012
JP 2012-149794 A 8/2012

* cited by examiner

TANK STRUCTURE FOR HEADER-PLATE-LESS HEAT EXCHANGER

BACKGROUND OF THE INVENTION

The present invention relates to a tank structure for a header-plate-less heat exchanger in which flat tubes whose both ends protrude are stacked to improve air-tightness and liquid-tightness between a core and a tank.

As illustrated in FIGS. 7 and 8, in the header-plate-less heat exchanger, flat tubes 2 whose both ends protrude in a thickness direction are stacked at a protruding part to for a core, and thus a header plate is not required. A casing 11 is fitted onto an outer circumference of a core 3 including a stack body of the flat tubes 2, and also a tank 4 is fitted onto both ends of the core 3 and the respective parts are integrally soldered and secured to each other.

As illustrated in FIG. 1, the flat tubes 2 include a pair of an upper plate 2*a* and a lower plate 2*b* each bent in a groove shape, which are fitted into each other with groove bottoms faced to each other. Further, the casing 11 includes a casing main body 11*a* formed in a groove shape and an edge cap 11*b* for closing a space between both side walls of the casing main body 11*a*. Furthermore, the tank 4 is integrally molded in a cylindrical shape having a square shape in cross section by press-molding.

Background prior art includes Japanese Patent Laid-Open No. 2011-002133 and Japanese Patent Laid-Open No. 2011-232020.

SUMMARY OF INVENTION

Such a header-plate-less heat exchanger and a tank 4 need to be joined to each other without a pap by soldering. However, as illustrated in FIG. 8, a gap is generated at a portion A between an opening end of the tank 4 and the flat tube 2, and thus air-tightness and liquid-tightness may be deteriorated. That is because, since the tank 4 is integrally formed by press-molding, the tank 4 springs back to roll back outside, thereby making it difficult to closely contact the flat tube 2 with the tank 4. Further, gaps are also generated at a portion B and a portion C as illustrated in FIG. 8. The gap of the portion B is generated at a fitting point between the upper plate 2*a* and the lower plate 2*b*. The gap of the portion C is generated at a joint between respective flat tubes 2 caused by R generated when the press-molding is performed on the respective plates 2*a* and 2*b*.

When the gaps are generated, solder runs out while soldering is performed, thereby deteriorating the air-tightness and liquid-tightness of the tank.

The purpose of the present invention is to provide a tank structure in which a gap is not generated at a soldering part between the tank 4 and the core 3 particularly.

A first aspect of the present invention is to tank structure for a header-plate-less heat exchanger in which flat tubes (2) having a protruding part (1) whose both ends protrude in a thickness direction, contact and are secured to each other at the protruding part to form a core (3) and openings of a pair of tanks (4) are connected to both ends of the core (3), wherein the tank (4) is formed in a square shape in cross section and formed of an upper end plate part (5) and a lower end plate part (6) respectively located at both upper and lower ends in a stacking direction oil the flat tubes (2), and a pair of side plate parts (7) orthogonal to the upper end plate part (5) and the lower end plate part (6); and wherein the upper end plate part (5) and the lower end plate part (6) protrude to a core (3) side from the side plate parts (7) to form an upper fitting part (8) and a lower fitting part (9), respectively, the upper fitting part (8) and the lower fitting part (9) are fitted in, in a state where an outer surface of the upper fitting part (8) contacts with an inner surface of an upper side part of an extending and opening part of an uppermost flat tube (2) in a stacking direction and, further, an outer surface of the lower fitting part (9) contacts with an inner surface of a lower side part of a lowermost flat tube (2), and at the fitting part, the flat tubes (2) and the tank (4) are soldered and secured to each other.

A second aspect of the present invention is the tank structure for a header-plate-less heat exchanger according to the first aspect, wherein end surfaces of the pair of side plate parts (7) are abutted on end surfaces of the respective flat tubes (2), and the abutting parts are soldered and secured to each other.

A third aspect of the present invention is the tank structure for a header-plate-less heat exchanger according to the first or second aspect, wherein the tank (4) is integrally formed in a square shape in cross section by press-molding and a gap (15) is formed only at a front end at the core side on each of borders between the pair of side plate parts (7) and the upper end plate part (5) and between the pair of side plate parts (7) and the lower end plate part (6).

A fourth aspect of the present invention is the tank structure for a header-plate-less heat exchanger according to any of the first to third aspects, including:

a casing (11) conforming to an outer circumference of the core (3) and including a casing main body (11*a*) in a groove shape and an edge can (11*b*) for closing a space between walls of both sides of the casing main body (11*a*), the casing (11) being fitted onto the outer circumference of the core (3) and an outer circumference of an end part of the tank (4), wherein soldering is performed on gaps of parts in a state where the upper side part of the extending and opening part of the uppermost flat tube (2) and the lower side part of the lowermost flat tube (2) are held between the tank (4) and the casing (11), and compressed.

A fifth aspect of the present invention is the tank structure for a header-plate-less heat exchanger according to any of the first to fourth aspects, wherein the upper end plate part (5) and the lower end plate part (6) are formed with a step inward by a thickness of the flat tube (2) the tank (4) is integrally formed in a square shape in cross section by press-molding and both fitting parts (8) and (9) of the upper end plate part (5) and the lower end plate part (6) are formed to have a width equal to an inner width of the extending and opening part of the flat tube (2).

In the first aspect of the invention, the upper fitting part 8 and the lower fitting part 9 are fitted in, in a state where an outer surface of the upper fitting part 8 of the tank 4 protruding to the core 3 side from the side plate part 7 contacts with an inner surface of an upper side part of an extending and opening part of an uppermost flat tube 2 in a stacking direction and, further, an outer surface of the lower fitting part 9 protruding in a similar manner contacts with an inner surface of a lower side part of a lowermost flat tube 2. At the fitting part, the flat tube and the tank are soldered and secured to each other. Since the upper end plate part and the lower endplate part protrude from the side plate part 7, they can be easily deformed in a thickness direction, so as to closely contact the contacting part of the flat tube 2. Therefore, the liquid-tightness and the air-tightness of a soldering part can be ensured.

In addition to the above described structure, in the second aspect of the invention, when the end surfaces of a pair of side plate parts 7 are abutted on end surfaces of the respective flat tubes 2 and then the abutment parts are soldered and secured, as illustrated in FIG. 8 of a prior art, gaps of a portion B and a portion C are closed, thereby ensuring the liquid-tightness and the air-tightness of the soldering part.

In addition to the above described structure, in the third aspect of the invention, when a gap 15 is formed only at a front end on each of borders between a pair of side plate parts 7 and the upper end plate part 5 and between a pair of side plate parts 7 and the lower end plate part 6, the upper end plate part and the lower end plate part are more easily deformed in the thickness direction of the side plate part 7, so as to closely contact the contacting part of the flat tube 2. Therefore, the liquid-tightness and the air-tightness of the soldering part can be ensured.

In addition to the above described structure, in the fourth aspect of the invention, when gaps of respective parts are soldered in a state where the upper side part of the extending and opening part of the uppermost flat tube 2 and the lower side part of the lowermost flat tube 2 are held between the tank 4 and the casing 11 and compressed, the gap between the contacting parts of the respective parts can be reliably eliminated, so that the soldering can be reliably performed.

In addition to the above described structure, in the fifth aspect of the invention, when the upper end plate part 5 and the lower end plate part 6 are formed with a step inward by a thickness of the flat tube 2, also the tank 4 is integrally formed in a square shape in cross section by the press-molding, and further a width of both fitting parts 8 and 9 is formed to be equal to an inner width of the expanding and opening part of the flat tube 2, the contacting parts between the both fitting parts 8 and 9 and the flat tube 2 are increased to improve reliability of the soldering.

DETAILED DESCRIPTION OF THE INVENTION

Subsequently, with reference to figures, embodiments of the present invention will be described below.

Figure 1:
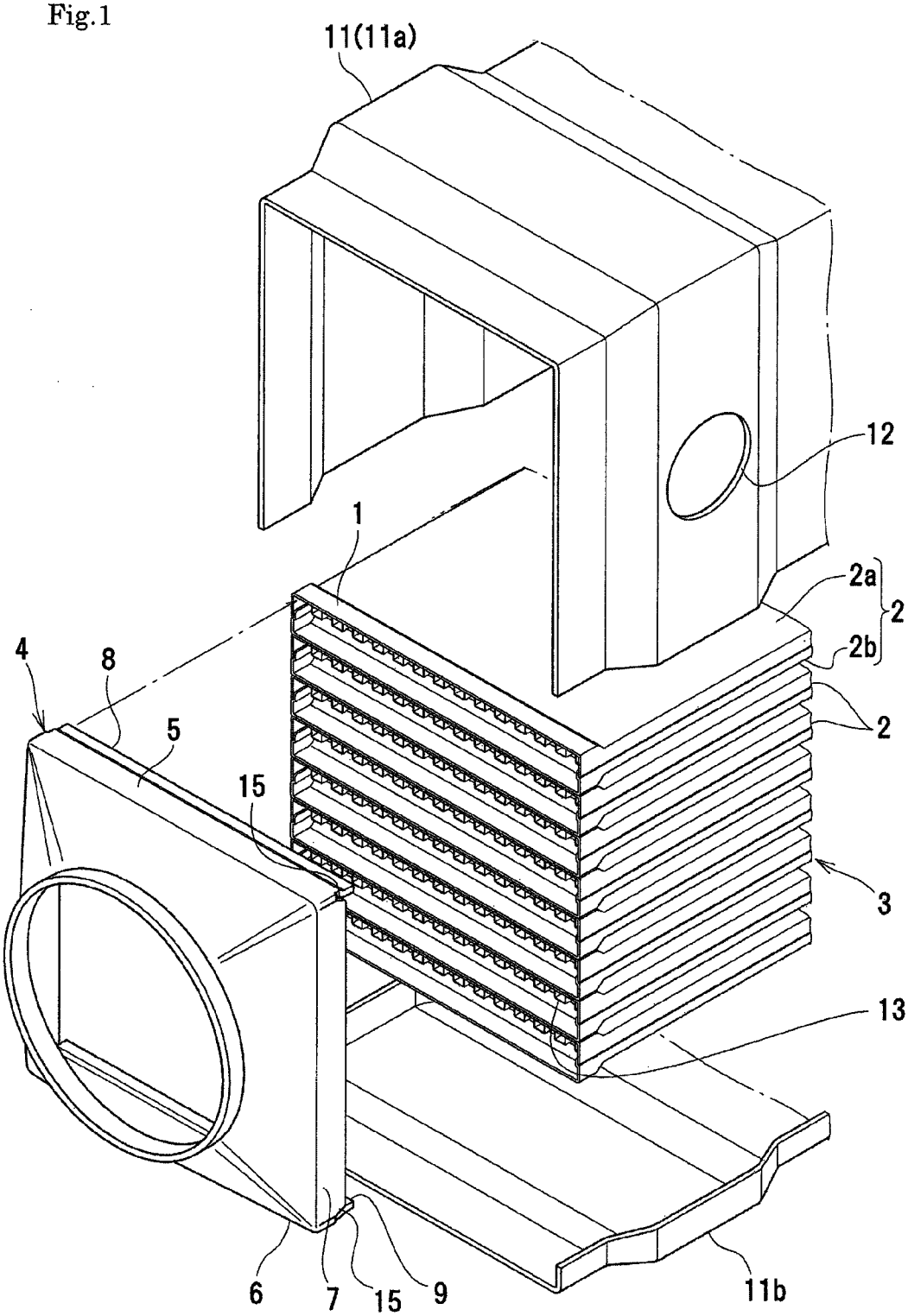
FIG. 1 is an exploded perspective view illustrating a tank structure for a header-plate-less heat exchanger of the present invention.
Figure 2:
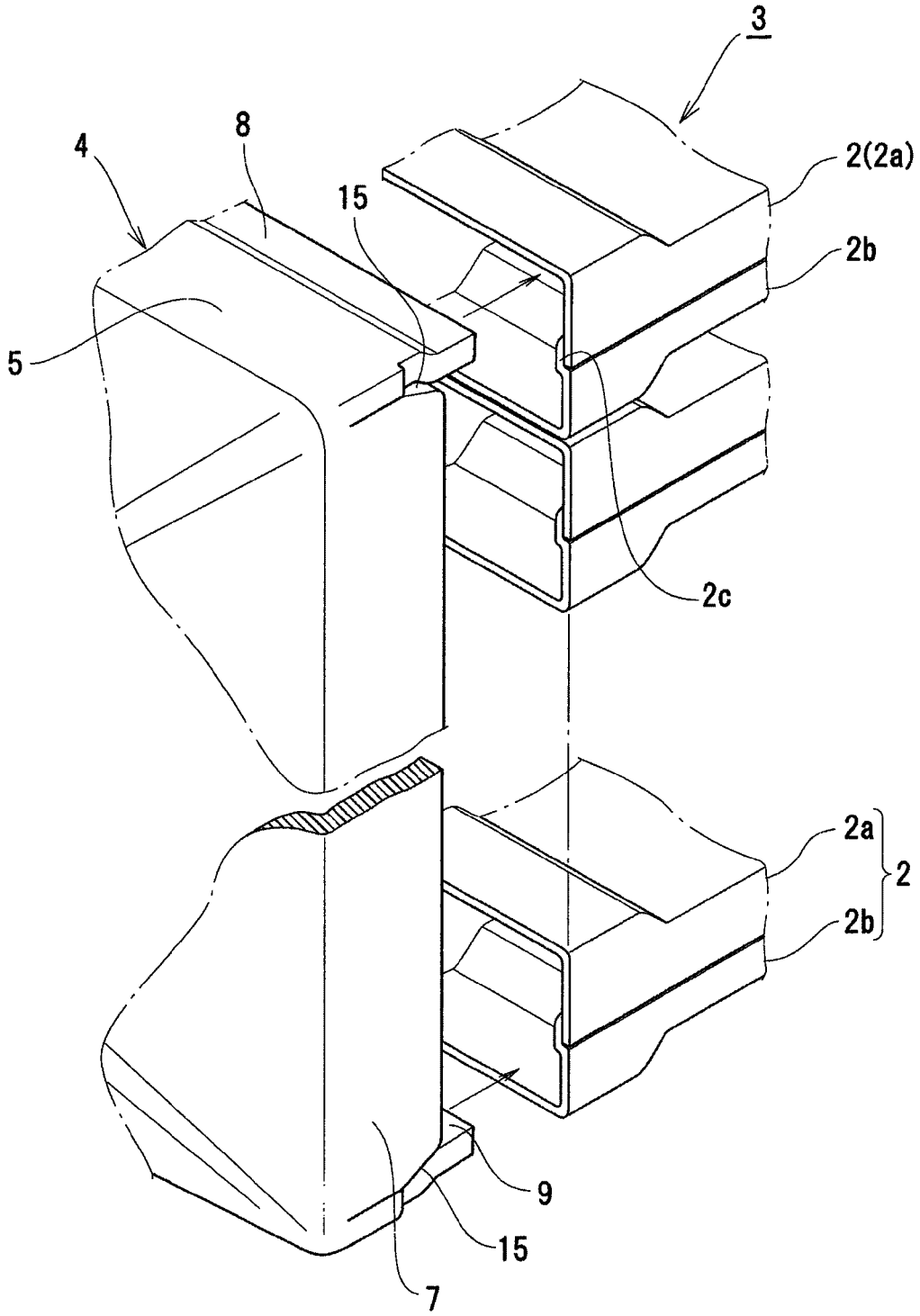
FIG. 2 illustrates assembly of the tank 4 described above and flat tubes 2.

As illustrated in FIG. 1, in the heat exchanger, a number of flat tubes 2 are stacked at protruding parts 1 on both ends of the flat tubes 2 to form a core 3 (right side is not illustrated). As illustrated in FIG. 2, the flat tubes 2 include a fitting body of an upper plate 2*a* and a lower plate 2*b* each formed in a groove shape. An upper part of a side wall of the lower plate 2*b* is molded with a step bent inward by a plate thickness of the plate 2*a* to form a stepped part 2*c* there. An upper end part of the lower plate 2*b* is fitted into an inside of the upper plate 2*a*. Both end, parts of the plate 2*a* and plate 2*b* in a longitudinal direction include the protruding part 1 protruding in the thickness direction. The plates 2*a* and 2*b* are fit with each other as illustrated in FIG. 2 to form the flat tubes 2. According to the embodiment, as illustrated in FIG. 1, inner fins 13 are intermediately provided in the respective flat tubes 2.

Subsequently, as illustrated in FIG. 1, the casing 11 includes a casing main body 11*a* formed in a groove shape and an edge cap 11*b* for closing a space between the walls of the both sides. The edge cap 11*b* is formed in a shallow groove shape that conforms to an outer circumference of the casing main body 11*a*.

Figure 4:
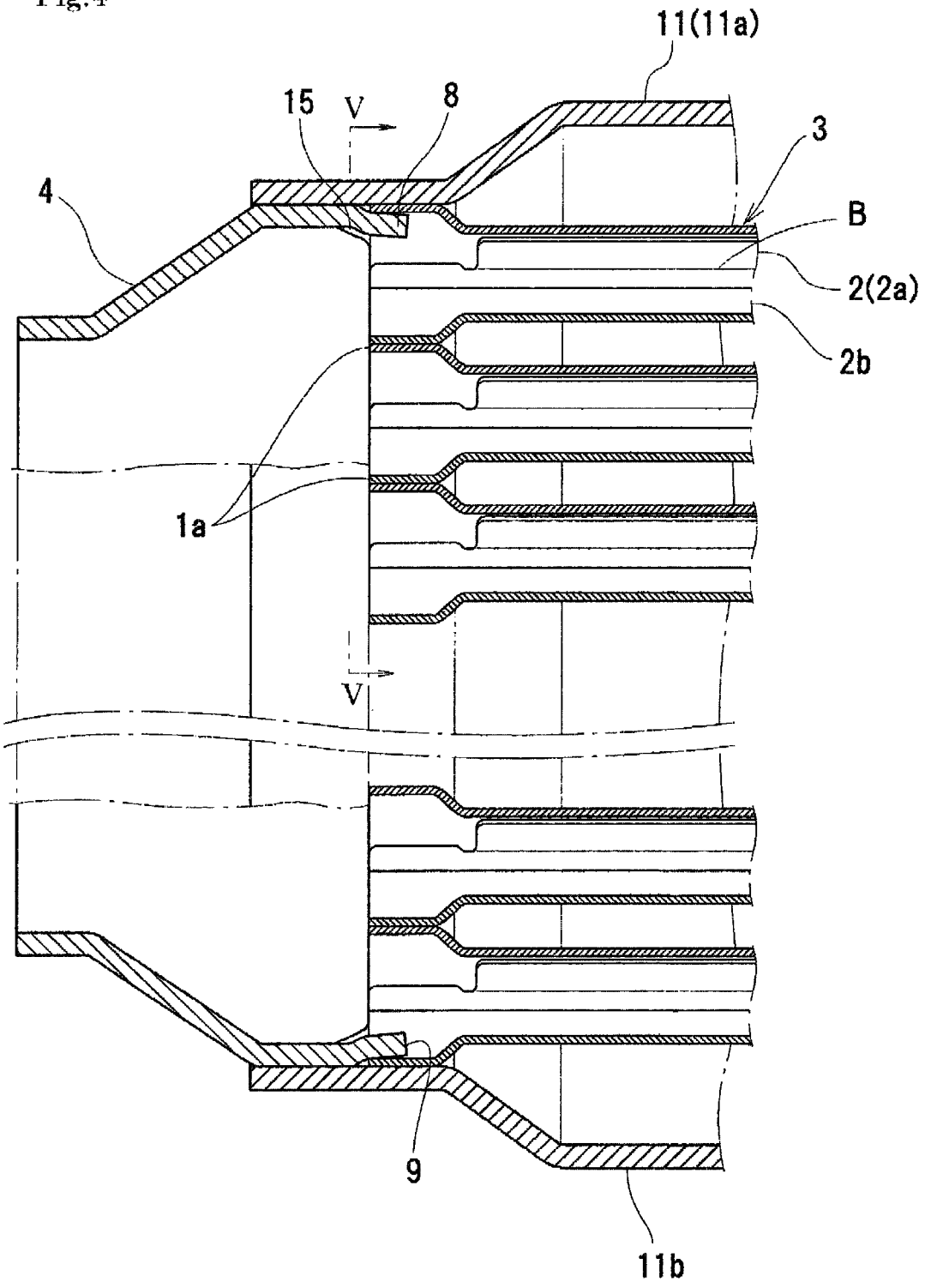
FIG. 4 is a vertical cross-sectional view.
Figure 5:
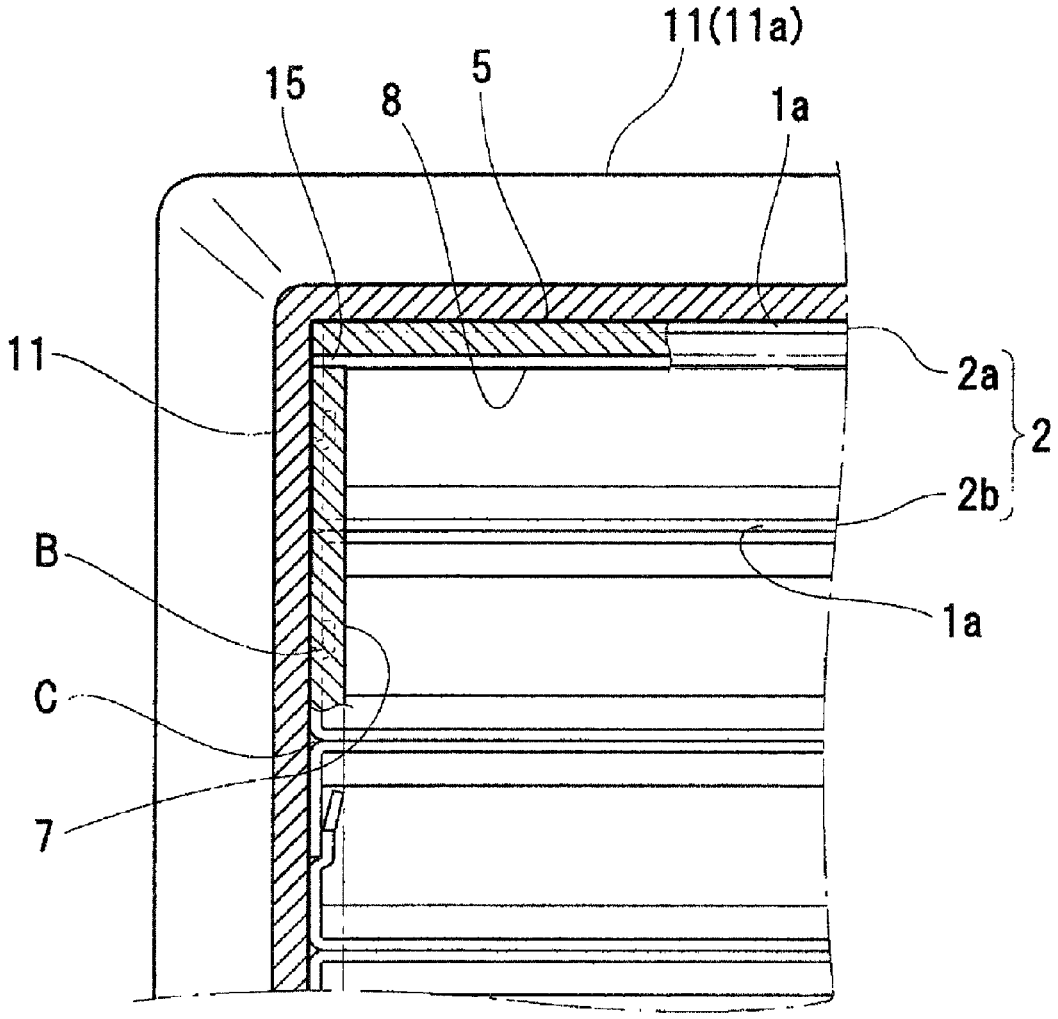
FIG. 5 is a schematic, perspective view taken along a line V-V illustrated in FIG. 4.

The tank 4 is integrally molded by a press-machine. As illustrated in FIG. 1, an entire tank 4 is formed in a shallow cone shape, and one end opening of the tank 4 is formed in a round shape and another end opening is formed in a square shape. Further, as illustrated in FIGS. 4 and 5, the plate thickness of the tank 4 is not smaller than a sum of plate thicknesses of the respective plates 2*a* and 2*b* in a groove shape and also not smaller than a depth of the gap C generated at a corner of a contacting part of the respective flat tubes 2 (depth of the flat tube in a width direction). The tank 4 is formed in a square shape in cross section by the upper end plate part 5 and the lower end plate part 6 vertically facing each other, and the pair of side plate parts 7 arranged at the both sides of the upper end plate part 5 and the lower end plate part 5. Further, the upper end plate part 5 and the lower end plate part 6 are provided with the upper fitting part 8 and the lower fitting part 9 formed with the step inward by the plate thickness of the flat tube 2. The upper fitting part 8 and the lower fitting part 9 protrude toward the core 3 side from the side plate part 7. In addition, the width of the upper fitting part 8 and the lower fitting part 9 preferably conforms to the inner width of the flat tube 2. Further, a height of both side plate parts 7 of the tank 4 is slightly lower than that of the core 3. Borders between the both side plate parts 7 and the upper fitting part 8 and also between the both side plate parts 7 and the lower fitting part 9 are separated by cutting parts 15 at the front end. The upper fitting, part B and the lower fitting part 9 are formed to be elastically deformable in the thickness direction. As illustrated in FIG. 5, a position of the cutting part 15 is located upper than a position B of a joint between the plates 2*a* and 2*b*.

Figure 3:
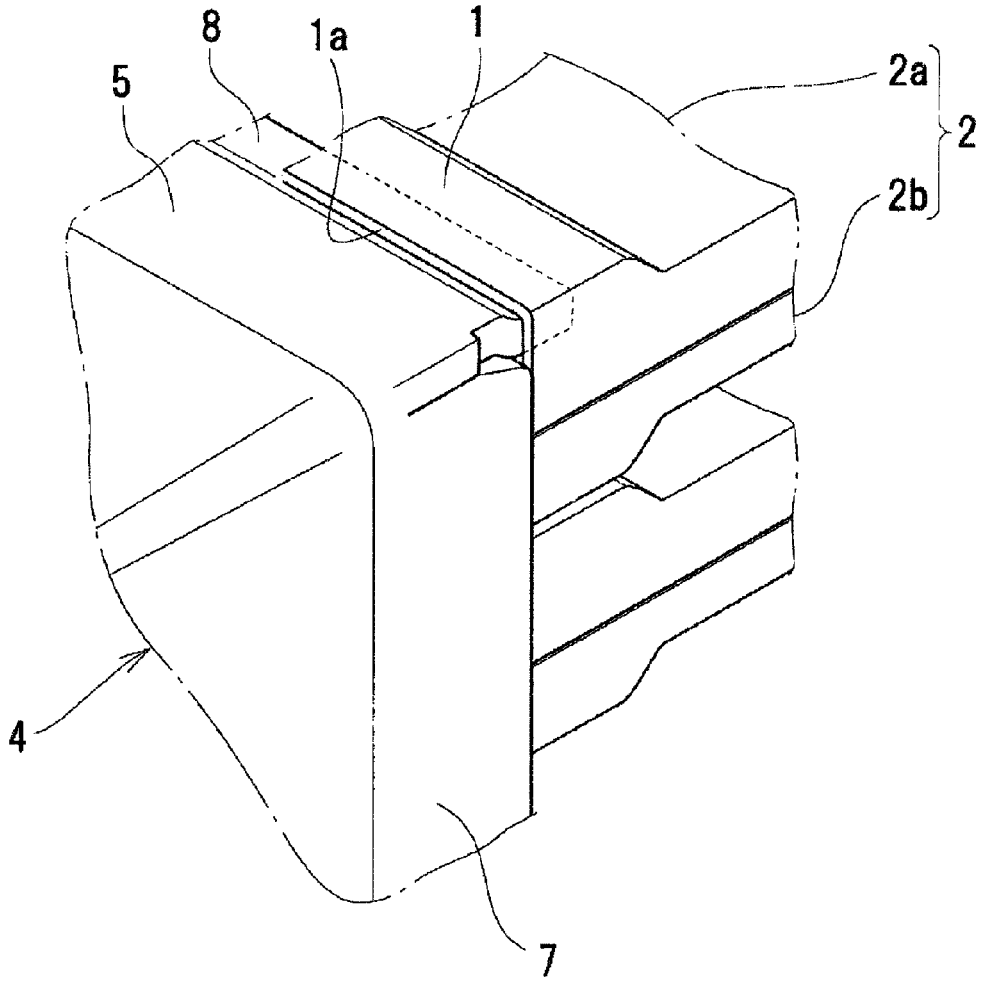
FIG. 3 is a perspective view of an essential part illustrating the assembly state described above.

As illustrated in FIGS. 2, 3 and 4, in the tank 4 structured as described above, the upper fitting part 8 is fitted inside the plate 2*a* of the uppermost flat tube 2 in the stacking direction of the core 3. The lower fitting part 9 contacts and is fitted into an inside of the plate 2*b* of the lowermost flat tune 2 in the stacking direction. At the same time, the end surfaces of the pair of side plate parts 7 are abutted on the end surfaces of the respective flat tubes 2. As a result, as illustrated in FIG. 5, the gap B of the joint between the plates 2*a* and 2*b*, and the gap C at the corner of a connection part of the respective flat tubes 2 are closed hr the end surface of the side plate part 7.

Subsequently, the heat exchanger is assembled as illustrated in FIGS. 3 and 4. Solder material is previously coated or applied in the gap between the contacting parts of the respective parts. As illustrated in FIG. 4, the casing main body ha is fitted from above onto the core 3 and the tank 4 and the edge cap 11*b* is fitted from beneath thereon. The end part of the upper plate 2*a* of the uppermost flat tube 2 is held between the upper fitting part 8 of the tank 4 and the casing main body 11*a*. Further, the end part of the lower plate 2*b* of the lowermost flat tube 2 is held, between the lower fitting part 9 of the tank 4 and the edge cap 11*b*.

Figure 8:
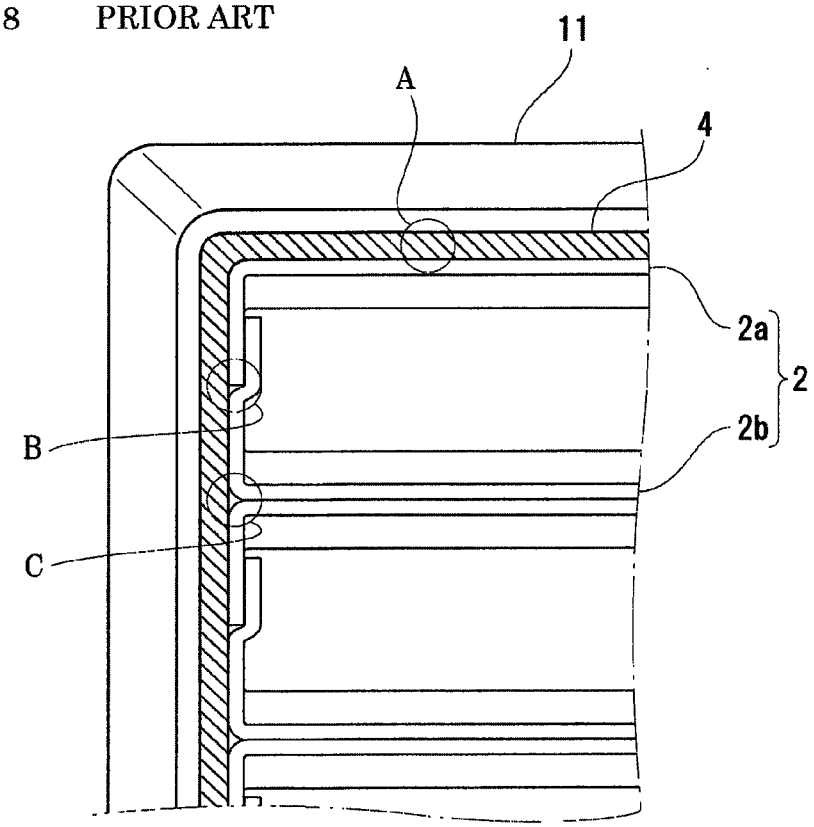
Fig.8 PRIOR ART
FIG. 8 is a cross-sectional view taken along a line VIII-VIII illustrated in FIG. 7.

When the soldering is performed, the end parts are soldered in a state where they closely contact with each other. At this point, the upper fitting part 8 and the lower fitting part 9 are elastically deformed more freely due to presence of the cutting parts 15, respectively, and the gaps between the parts adjacent to each other are soldered in a state of close contact. In order to do so, the outer circumference of the casing 11 is fastened inward, with a tool (not illustrated) and soldered. Then, the air-tightness and the liquid-tightness can be ensured without generating the gap between the tank 4 and the respective flat tubes 2. The gaps generated at A illustrated in FIG. 8 in the heat exchanger of the prior art are each closed, thereby ensuring the air-tightness and the liquid-tightness.

As illustrated in FIG. 1, the casing 11 is formed with a cooling water entrance and exit 12 at the both end parts of the casing main body 11*a* in the longitudinal direction, and the cooling water flows in through the cooling water entrance and exit 12 to be supplied to the gaps between the respective flat tubes 2. Further, as an example, exhaust gas at high temperature flows in from one tank 4 side, and flows through the respective flat tubes 2 to exchange heat with the cooling water.

Figure 6:
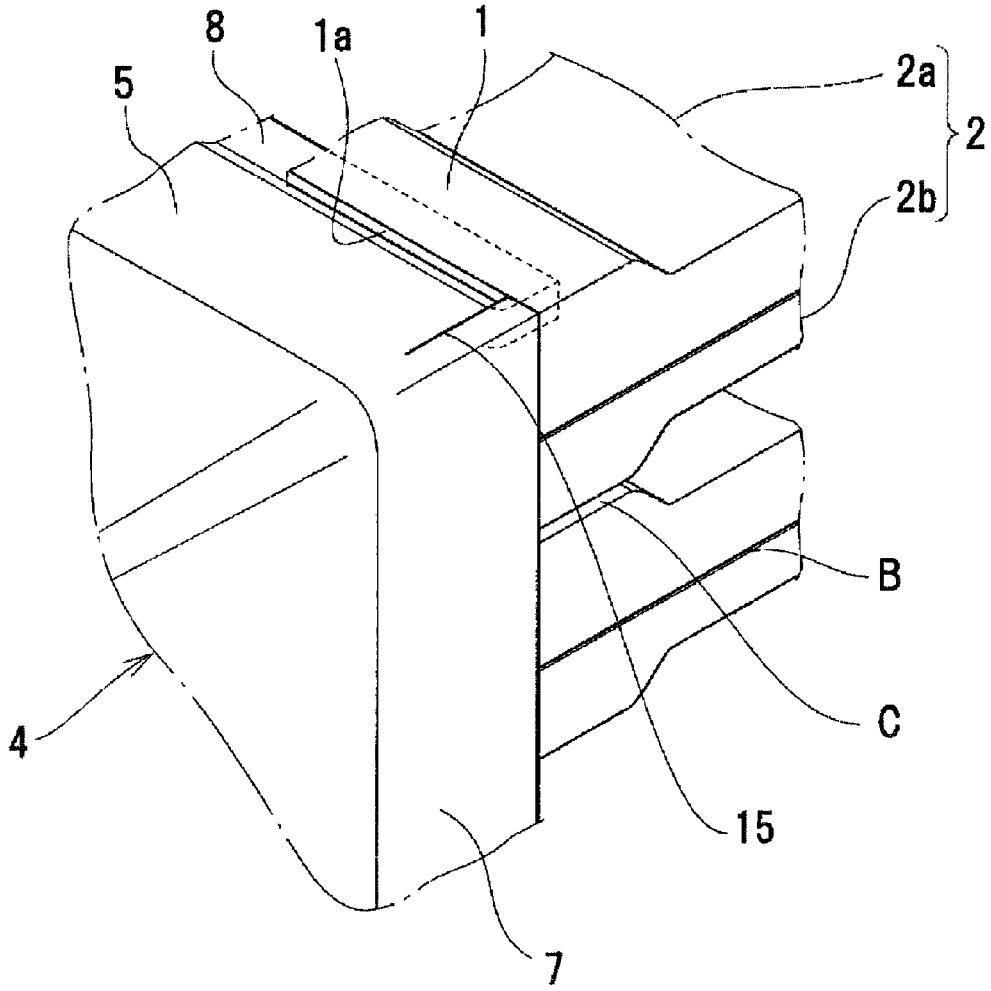
FIG. 6 is a perspective view illustrating an essential part of another tank structure of the present invention.
Figure 7:
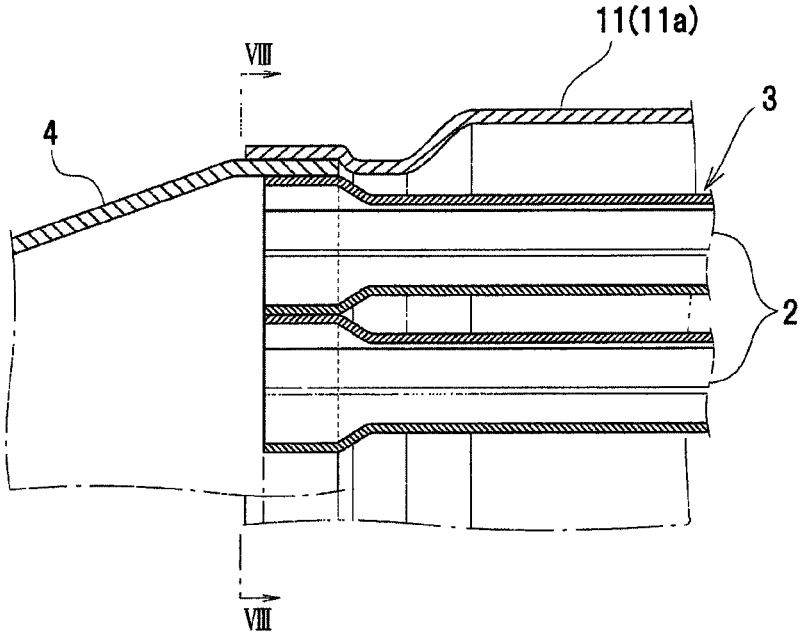
Fig.7 PRIOR ART
FIG. 7 is a vertical cross-sectional view illustrating an essential part of a heat exchanger of prior art.

Subsequently, FIG. 6 is a perspective view of an essential part according to a second embodiment of the present invention. Difference between the embodiment described above and the first embodiment is only positions of the upper end plate part 5 and the lower end plate part 6 of the tank 4, and also the cutting parts 15 of the both side plate parts 7. According to the embodiment, the cutting parts 15 are formed on the upper surface of the upper end plate part 5 and the lower surface of the lower end plate part 6.

The invention claimed is:

1. A tank structure for a header-plate-less heat exchanger comprising flat tubes each having a protruding part whose both ends protrude in a thickness direction, contact and are secured to each other at the protruding part to form a core, and further comprising a first and second tank portions each having an opening connected to a respective side of the core, wherein the first tank portion is formed in a square shape in cross section and formed of an upper end plate part and a lower end plate part respectively located at both upper and lower ends in a stacking direction of the flat tubes, and a pair of side plate parts orthogonal to the upper end plate part and the lower end plate part; and wherein a casing is fitted to an outer perimeter of the core;

wherein the upper end plate part and the lower end plate part protrude to a core side from said side plate parts to form an upper fitting part and a lower fitting part, respectively, the upper fitting part and the lower fitting part are positioned such that an outer surface of the upper fitting part contacts with an inner surface of an upper side part of an extending and opening part of an uppermost flat tube of the core in a stacking direction and, further, an outer surface of the lower fitting part contacts with an inner surface of a lower side part of an extending and opening part of a lowermost flat tube of the core, and the upper side part of the extending and opening part of the uppermost flat tube of the core is sandwiched between the upper fitting part of the first tank portion and the casing, and the lower side part of the extending and opening part of the lowermost flat tube of the core is sandwiched between the lower fitting part of the first tank portion and the casing, and at the fitting part, the casing, the core and the first tank portion are soldered and secured to each other.

2. The tank structure for a header-plate-less heat exchanger according to claim 1, wherein end surfaces of said pair of side plate parts are abutted on end surfaces of the respective flat tubes, and the abutting parts are soldered and secured to each other.

3. The tank structure for a header-plate-less heat exchanger according to claim 1, wherein said first tank portion is integrally formed in a square shape in cross section by press-molding, and a gap is formed only at a front end of the first tank portion at the core side on each of intersections between the pair of side plate parts and the upper end plate part and between the pair of side plate parts and the lower end plate part.

4. The tank structure for a header-plate-less heat exchanger according to claim 1, wherein the casing includes a casing main body having a groove shape and an edge cap for closing a space between walls of both sides of the casing main body, the casing being fitted onto the outer perimeter of the core and an outer perimeter of an end part of the first tank portion, wherein soldering is performed on gaps of parts such that the upper side part of the extending and opening part of the uppermost flat tube and the lower side part of the extending and opening part of the lowermost flat tube are held between the first tank portion and the casing, and compressed.

5. The tank structure for a header-plate-less heat exchanger according to claim 1, wherein the upper end plate part and the lower end plate part are formed with a step inward having a same thickness as a flat tube portion, wherein said first tank portion is integrally formed in a square shape in cross section by press-molding, and the both fitting parts of the upper end plate part and the lower end plate part are formed to have a width equal to an inner width of the extending and opening parts of the flat tube.

6. The tank structure for a header-plate-less heat exchanger according to claim 2, wherein said first tank portion is integrally formed in a square shape in cross section by press-molding, and a gap is formed only at a front end of the first tank portion at the core side on each of intersections between the pair of side plate parts and the upper end plate part and between the pair of side plate parts and the lower end plate part.

7. The tank structure for a header-plate-less heat exchanger according to claim 2, wherein the casing includes a casing main body having a groove shape and an edge cap for closing a space between walls of both sides of the casing main body, the casing being fitted onto the outer perimeter of the core and an outer perimeter of an end part of the first tank portion, wherein soldering is performed on gaps of parts such that the upper side part of the extending and opening part of the uppermost flat tube and the lower side part of the extending and opening part of the lowermost flat tube are held between the first tank portion and the casing, and compressed.

8. The tank structure for a header-plate-less heat exchanger according to claim 2, wherein the upper end plate part and the lower end plate part are formed with a step inward having a same thickness as a flat tube portion, wherein first tank portion is integrally formed in a square shape in cross section by press-molding, and the both fitting parts of the upper end plate part and the lower end plate part are formed to have a width equal to an inner width of the extending and opening parts of the flat tubes.

9. The tank structure for a header-plate-less heat exchanger according to claim 3, wherein the casing includes a casing main body having a groove shape and an edge cap for closing a space between walls of both sides of the casing main body, the casing being fitted onto the outer perimeter of the core and an outer perimeter of an end part of the first tank portion, wherein soldering is performed on gaps of parts such that the upper side part of the extending and opening part of the uppermost flat tube and the lower side part of the e tending and, opening part of the lowermost flat tube are held between the first tank portion and the casing, and compressed.

10. The tank structure for a header-plate-less heat exchanger according to claim 3, wherein the upper end plate part and the lower end plate part are formed with a step inward having a same thickness as a flat tube portion, said first tank portion is integrally formed in a square shape in cross section by press-molding, and the both fitting parts of the upper end plate part and the lower end plate part are formed to have a width equal to an inner width of the extending and opening parts of the flat tubes.

11. The tank structure for a header-plate-less heat exchanger according to claim 4, wherein the upper end plate part and the lower end plate part are formed with a step inward having a same thickness as a flat tube portion, wherein said first tank portion is integrally formed in a square shape in cross section by press-molding, and the both fitting parts of the upper end plate part and the lower end plate part are formed to have a width equal to an inner width of the extending and opening parts of the flat tubes.

12. The tank structure for a header-plate-less heat exchanger according to claim 2, wherein said first tank portion is integrally formed in a square shape in cross section by press-molding, and a gap is formed only at a front end of the first tank portion at the core side on each of intersections between the pair of side plate parts and the upper end plate part and between the pair of side plate parts and the lower end plate part;

and wherein the casing includes a casing main body having a groove shape and an edge cap for closing a space between walls of both sides of the casing main body, the casing being fitted onto the outer perimeter of the core and an outer perimeter of an end part of the first tank portion, wherein soldering is performed on gaps of parts such that the upper side part of the extending and opening part of the uppermost flat tube and the lower side part of the extending and opening part of the lowermost flat tube are held between the first tank portion and the casing, and compressed.

13. The tank structure for a header-plate-less heat exchanger according to claim 2, wherein said first tank portion is integrally formed in a square shape in cross section by press-molding, and a gap is formed only at a front end of the first tank portion at the core side on each of intersections between the pair of side plate parts and the upper end plate part and between the pair of side plate parts and the lower end plate part; and wherein the upper end plate part and the lower end plate part are formed with a step inward having a same thickness as a flat tube portion, and the both fitting parts of the upper end plate part and the lower end plate part are formed to have a width equal to an inner width of the extending and opening parts of the flat tubes.

14. The tank structure for a header-plate-less heat exchanger according to claim 2, wherein the upper end plate part and the lower end plate part are formed with a step inward having a same thickness as a flat tube portion, and the both fitting parts of the upper end plate part and the lower end plate part are formed to have a width equal to an inner width of the extending and opening part of the flat tubes, and wherein the casing comprises a casing main body having a groove shape and an edge cap for closing a space between walls of both sides of the casing main body, the casing being fitted onto the outer perimeter of the core and an outer perimeter of an end part of the first tank portion, wherein soldering is performed on gaps of parts such that the upper side part of the extending and opening part of the uppermost flat tube and the lower side part of the extending and opening part of the lowermost flat tube are held between the first tank portion and the casing, and compressed.

* * * * *